US006761607B2

(12) United States Patent
Kikuchi et al.

(10) Patent No.: US 6,761,607 B2
(45) Date of Patent: Jul. 13, 2004

(54) APPARATUS, MOLD AND METHOD FOR PRODUCING SUBSTRATE FOR PLASMA DISPLAY PANEL

(75) Inventors: Hiroshi Kikuchi, Yamato (JP); Chikafumi Yokoyama, Zama (JP); Akira Yoda, Machida (JP); Takaki Sugimoto, Komae (JP); Toshihiro Suwa, Sagamahara (JP)

(73) Assignee: 3M Innovative Properties Company, St. Paul, MN (US)

( * ) Notice: Subject to any disclaimer, the term of this patent is extended or adjusted under 35 U.S.C. 154(b) by 0 days.

(21) Appl. No.: 10/168,167

(22) PCT Filed: Jan. 3, 2001

(86) PCT No.: PCT/US01/00101

§ 371 (c)(1),
(2), (4) Date: Jun. 17, 2002

(87) PCT Pub. No.: WO01/52299

PCT Pub. Date: Jul. 19, 2001

(65) Prior Publication Data

US 2003/0022585 A1 Jan. 30, 2003

(30) Foreign Application Priority Data

Jan. 11, 2000 (JP) ..... 2000-006200

(51) Int. Cl.[7] ..... H01J 9/00
(52) U.S. Cl. ..... 445/24; 445/25; 264/313
(58) Field of Search ..... 445/24, 25; 313/582, 313/586, 587; 264/313

(56) References Cited

U.S. PATENT DOCUMENTS

| | | | | | |
|---|---|---|---|---|---|
| 4,332,841 | A | | 6/1982 | Price | |
| 5,747,931 | A | * | 5/1998 | Riddle et al. | 313/586 |
| 5,853,446 | A | | 12/1998 | Carre et al. | |
| 5,967,871 | A | * | 10/1999 | Kaake et al. | 445/24 |
| 6,247,986 | B1 | * | 6/2001 | Chiu et al. | 445/24 |
| 6,306,948 | B1 | * | 10/2001 | Yokoyama et al. | 524/492 |
| 6,485,596 | B1 | * | 11/2002 | Toyoda et al. | 264/313 |

FOREIGN PATENT DOCUMENTS

| | | |
|---|---|---|
| EP | 0 837 486 A2 A3 | 4/1998 |
| JP | 11-067106 | 3/1999 |
| JP | 11-297195 | 10/1999 |
| JP | 11-329227 | 11/1999 |
| JP | 2001-058352 | 3/2001 |
| WO | WO 01/95361 | 12/2001 |

* cited by examiner

*Primary Examiner*—Kenneth J. Ramsey
*Assistant Examiner*—Mariceli Santiago
(74) *Attorney, Agent, or Firm*—Carolyn A. Fischer

(57) ABSTRACT

An apparatus is provided for producing a substrate for PDP, which can easily reduce ununiformity of a dielectric layer and defects of ribs. The apparatus is so constituted that it comprises: a table for the plate, a rib precursor supplying portion for providing a precusor of the ribs on the plate, a pliable mold having at least groove portions provided in parallel with each other at a fixed distance, which is disposed on the precursor of the ribs provided on the plate, a mold pressing portion for applying a pressure to the mold, thereby to contact the mold closely with the plate via the precursor of the ribs, and a driving portion for moving the mold pressing portion along the groove portions of the mold.

2 Claims, 7 Drawing Sheets

APPARATUS, MOLD AND METHOD FOR PRODUCING SUBSTRATE FOR PLASMA DISPLAY PANEL

TECHNICAL FIELD

The present invention belongs to the field of plasma display panels (hereinafter also referred to as "PDP") and, more particularly, it relates to an apparatus for producing a substrate for PDP, a mold used in such production apparatus, and a method of producing a substrate for PDP.

BACKGROUND

Recently, thin display devices such as PDPs have been developed intensively. Because PDPs are thin and can also provide a large image plane, high image quality and wide viewing angle can be achieved as compared with a typical thin display device such as liquid crystal display.

Generally, PDP is equipped with a substrate. Typical substrates for PDP is composed of a pair of glass flat plates facing each other at a distance via ribs each having the same dimension (also referred to as a barrier rib, bulkhead or barrier). Such ribs of the substrate for PDP with such a constitution can partition the space between a pair of glass plates in an air-tight manner to form a plurality of discharge display cells capable of containing a gas, which emits light by discharging, such as neon, helium or xenon.

Describing the substrate for PDP in more detail, as shown in FIG. 10, the substrate 10 for PDP has such as constitution that electrodes 2 are disposed in parallel with each other at a fixed distance on a glass plate 1 and each rib 3 is provided thereon. The electrodes 2 may be coated with a dielectric layer so as to avoid sputtering of the electrodes due to discharging of a gas, if necessary. In the embodiment shown in the drawing, each rib 3 is provided between the electrodes 2 in a state of being integrated with a dielectric layer 4.

Various methods of producing ribs of the substrate for PDP have been known. For example, Japanese Unexamined Patent Publication (KOKAI) No. 9-122336 discloses a method using a mold. According to this method, the ribs are produced by coating the whole surface of a mold or a glass plate with a curable pasty precursor of the ribs (hereinafter also referred to as a "rib precursor"). The mold and glass plate were then closely contacted with the rib precursor disposed between. Next, the rib precursor was cured and molded to obtain desired ribs.

The mold used in this method of producing the ribs is made of glass or metal. Generally, it is necessary to use a mold produced with high working accuracy in case where the mold and glass plate are closely contacted each other, uniformly. Otherwise, there is a tendency that a non-uniform dielectric layer may be molded integrally with the ribs. In case where the glass plate or mold have a comparatively wide area, this undesired tendency is increased. According to this method, there is a fear that, when the mold is removed from the glass plate, peeling of the ribs from the glass plate can occur, thereby making it impossible to properly transfer the ribs to the glass plate. This is because a comparatively large force must be applied to the mold due to the above-described rigidity On the other hand, Japanese Unexamined Patent Publication (KOKAI) No. 9-12336 discloses that entrapping of air bubbles between the mold and glass plate is prevented by close contact between the mold and glass plate under reduced pressure. It is usually required to use a pressure reducing device accompanying complicated constitution and complicated handling for such pressure reduction The pressure reducing device is large in size and often requires additional equipment. Close contact under reduced pressure requires not only a wide space for such equipment, but also complicated step and skill.

Japanese Unexamined Patent Publication (KOKAI) Nos. 8-273537 and 8-273538 disclose a method of producing ribs by using a mold having pliability Describing in more detail, Japanese Unexamined Patent Publication (KOKAI) No. 8-273537 discloses that a mold is filled with a rib precursor using a blade and then this mold is closely contacted with a glass plate. On the other hand, Japanese Unexamined Patent Publication (KOKAI) No. 8-273538 discloses that the whole surface of a glass plate is previously coated with a rib precursor and then a mold is closely contacted with the glass plate. However, according to both of these methods, there is a tendency that air bubbles are entrapped between the mold and plate upon close contact. Such entrapment of air bubbles is likely to introduce defects into the ribs. Particularly, in case where the substrate for PDP has a wide area, many defects can occur. As disclosed in Japanese Unexamined Patent Publication (KOKAI) No. 9-12336, a suggestion of avoiding entrapment of air bubbles by closely contacting the mold with the glass plate under reduced pressure is made. However, as described above, use of the pressure reducing device requires wide space and skill, which is not preferred.

SUMMARY OF INVENTION

It is, therefore, an object of the present invention to provide an improved method of and an improved apparatus for producing a substrate for PDP, which can easily reduce nonuniformity of a dielectric layer and defects of ribs.

Another object of the present invention is to provide a mold which can be advantageously used in the method and apparatus.

According to the present invention, there is provided an apparatus for producing a substrate for plasma display panel comprising a plate and ribs provided on the plate, which comprises:

- a table for the plate,
- a rib precursor supplying portion for providing a precursor of the ribs on the plate,
- a pliable mold having at least groove portions provided in parallel with each other at a fixed distance, which is disposed on the precursor of the ribs provided on the plate,
- a mold pressing portion for applying a pressure to the mold, thereby to contact the mold closely with the plate via the precursor of the rib, and
- a driving portion for moving the mold pressing portion along the groove portions of the mold.

According to the present invention, there is also provided a mold for use in the production of a substrate for plasma display panel, which is subjected to antistatic finish.

According to the present invention, there is also provided a mold for use in the production of a substrate for plasma display panel, comprising:

- an acrylic base material,
- an ionic conductive substance dispersed in the acrylic base material, and
- a medium which is dispersed, thereby making it possible to ionize the ionic conductive substance.

In addition, according to the present invention, there is provided a method of producing a substrate for plasma display panel comprising a plate and ribs provided on the plate, (A) which comprises the steps of:

a rib precursor supplying step of providing a precursor of the ribs on the plate, a rib precursor filling step of filling a pliable and antistatically treated mold having at least groove portions provided in parallel with each other at a fixed distance, with the rib precursor, a rib precursor molding step of curing the rib precursor to form a molded article, and a rib molded article transferring step of removing the mold and transferring the molded article to the plate, and (B) in which:

the mold is pressed along the groove portions from one end to the other end of the groove portions provided thereon in the rib precursor filling step.

DETAILED DESCRIPTION

Figure 1:
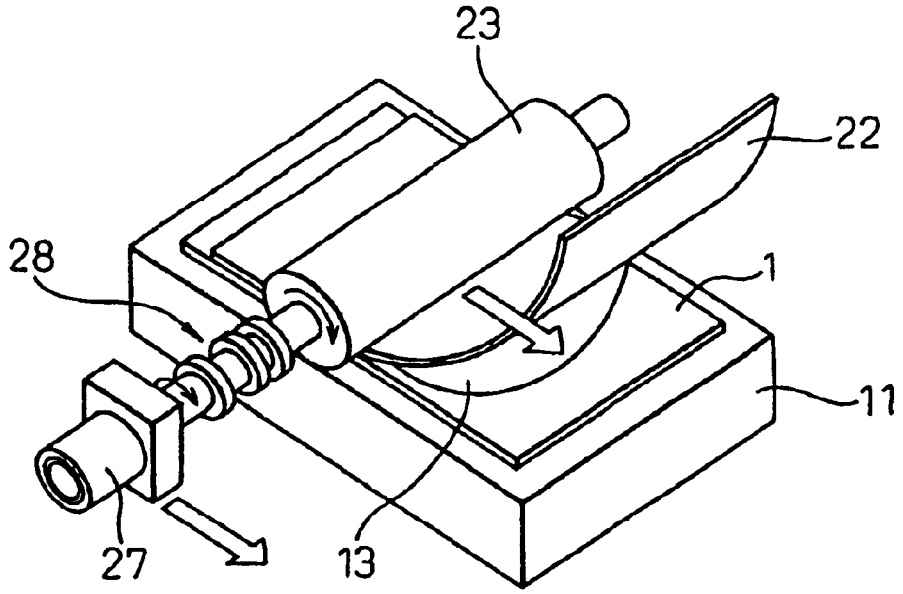
FIG. 1 is a perspective view showing, one embodiment of an apparatus for producing a substrate for PDP.

Various embodiments of the present invention will now be described with reference to the accompanying drawings. In the drawings to be referred, the same reference numerals are applied to the same or equivalent parts.

Figure 2:
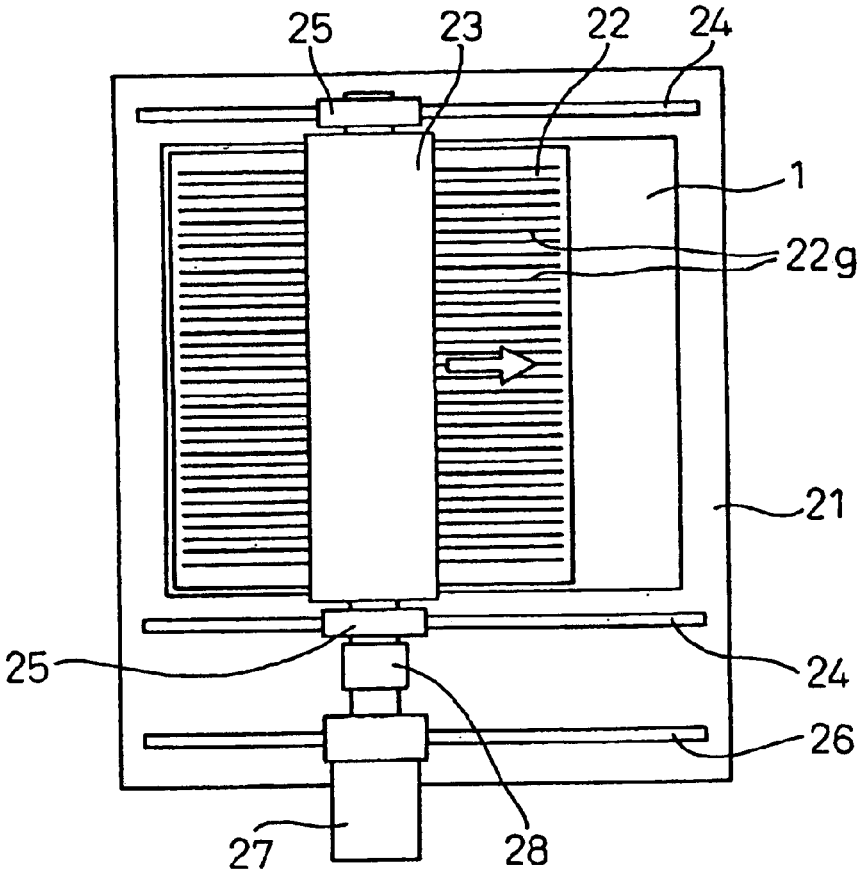
FIG. 2 is a top view showing the apparatus shown in FIG. 1
Figure 3:
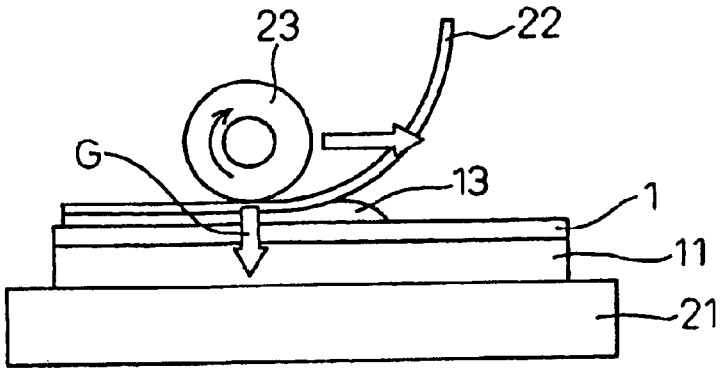
FIG. 3 is a side view showing the apparatus shown in FIG. 1.

FIG. 1 and FIG. 2 are a perspective view and a top view, each showing schematically one preferred embodiment of an apparatus for producing a substrate for PDP in accordance with the present invention. The apparatus shown in the drawing is constituted so that a glass plate 1 is placed on a table 11. Accordingly, the surface of the table 11 is machined accurately and smoothly. Preferably, as shown in FIG. 3, the table 1 may be placed on a stage 21. Also in this case, the glass plate 1 is placed on the table 11. In such case, by moving the stage 21, the position of the glass plate 1 thereon can be finely adjusted. On the glass plate 1, a rib precursor 13 is supplied.

The apparatus for producing the substrate for PDP of the present invention is equipped with a rib precursor supplying portion (hereinafter also referred to as a "rib precursor supplying device"). The rib precursor supplying device is not specifically limited as far as it can supply the rib precursor on the glass plate, and preferred examples thereof include nozzle for supplying a fixed amount, knife coater, screen printing device, and die coater.

The rib precursor to be supplied in the apparatus of the present invention is not specifically limited as far as the rib precursor can form a molded article. One example of preferred formulation for rib precursor is a composition containing basically (1) a ceramic component capable of affording the shape of the rib, such as aluminum oxide, (2) a binder component for binding ceramic components each other by containing and retaining them, or its curing agent or polymerization initiator, and (3) a glass component capable of filling the space between the ceramic components to afford denseness to the rib. The binder component is preferably cured by irradiating with light, not cured by heating or warming. In such case, it becomes unnecessary to consider thermal deformation of the glass plate. If necessary, an oxidizing catalyst made of an oxide, salt or complex of chromium (Cr), manganese (Mn), iron (Fe), cobalt (Co), nickel (Ni), copper (Cu), zinc (Zn), indium (In) or tin (Sn), ruthenium (Ru), rhodium (Rh), palladium (Pd), silver (Ag), iridium (Ir), platinum (Pt), gold (Au) or cerium (Ce) may be added to the composition, thereby to lower the temperature at which the binder component is removed.

On the glass plate 1, as shown in the drawing, the mold 22 is disposed. A typical mold is made by supporting a molding portion on a pliable supporting film. Preferred supporting film has a thickness of 30 $\mu$m or more. The supporting film having a thickness smaller than 30 $\mu$m tends to cause breakage of the mold without affording a sufficient strength to the mold. When using once broken mold again, there is a fear that defects are introduced into the ribs and dielectric layer. Preferred supporting film is, for example, a polyethylene terephthalate (PET) film. The PET film is transparent and is very advantageous to curing of the rib precursor due to irradiation with light. More preferably, it is a PET film whose internal stress is removed. In such case, since the film is superior in dimensional stability regardless of the temperature or humidity, the mold with such a film can maintain high dimensional accuracy.

The mold 22 has pliability at the molding portion and is equipped with groove portions 22*g* arranged in parallel each other at a fixed distance corresponding to the shape of ribs, as shown in the drawing. Preferred molding portion can be made of an acrylic base material by using photolithography. Since the molding portion thus obtained is transparent, use of the photocurable rib precursor becomes advantageous Describing in detail, the above-described base material, which is useful for producing the molding portion, is made of a cured article of urethane acrylate, polyester acrylate or polyether acrylate polymerized by adding a photocuring initiator. Particularly, when the base material is made of a cured article of urethane acrylate, properties such as high pliability and strong toughness can be afforded to the mold.

When the above-described rib precursor is irradiated with light to form a cured article, a curing agent or a polymerization initiator of the rib precursor has preferably an absorption end at a wavelength longer than that of the photocuring initiator of the molding portion. In such case, the photocuring initiator contained in the mold can not absorb light having a wavelength longer than that of the absorption end. To the contrary, the curing agent or polymerization initiator can absorb such light. As a result, even if the unreacted photocuring agent is remained in the molding portion, irradiation with light having the above-described wavelength does not cause photopolymerization with the binder component and adhesion between the mold and molded article is avoided. Accordingly, the glass plate or molded article or its free end is not remained in the mold after breakage, and removal of them can be easily conducted. The term "absorption end" used in the present specification refers to a portion of wavelength wherein an absorbency in a continuous absorption spectrum of light rapidly decreases when the wavelength becomes longer than said wavelength, resulting in substantially transparent state.

The mold is preferably subjected to antistatic treatment. When it is subjected to antistatic treatment, the mold is hardly charged as a result of lowering of the surface resistance, thereby making it possible to avoid adhesion of surrounding charged dusts. Particularly, when the antistatic treatment is conducted by affording ionic conductivity to the mold, the antistatic treatment can be carried out without being influenced by the surrounding environment. Specifically, it is preferred to disperse an ionic conductive substance made of a lithium salt such as lithium perchlorate, and a colorless medium, which is made of ethylene glycol or lactone or a derivative thereof and is capable of ionizing the ionic conductive substance, into the base material of the mold. The antistatic treatment of the mold is not limited to the above method, and a method using a surfactant may also be used.

As shown in FIGS. 1 to 3, a pressing means, ie. lamination roller 23 as a mold pressing portion is disposed on a mold 22. As shown in FIG. 3, the lamination roller 23 can bring the mold 22 into closely contact with the glass plate 1 via the rib precursor 13 by applying a pressure to the mold 22 utilizing its own weight G, thereby making it possible to integrate the dielectric layer (not shown) with the rib precursor 13, simultaneously. The lamination roller has preferably uniform weight distribution and cylindricity along the width direction. In such case, the lamination roller 23 can uniformly conduct the above-described integration molding by adding a fixed pressure along the longitudinal direction. The lamination roller 23 may have any desired diameter insofar as it can enable to conduct uniform integration molding, however, generally, it has a diameter of about 25 mm or more, preferably, a diameter of about 100 mm or more. The lamination roller 23 having a diameter smaller than about 25 mm tends to entrap an air on lamination of the rib precursor 13, and the air thus trapped can cause defects of ribs.

Examples of the lamination roller, which is useful as the mold pressing portion, include elastic roller whose surface is uniformly surrounded with an elastic material, or metal roller having a metal surface. Particularly, the elastic roller can be advantageously used to reduce local ununiformity of the pliable mold or glass plate, that is, to permit a slight error in thickness of the glass plate and mold. The elastic material of the elastic roller preferably has Shore 'A' hardness within a range from 50 to 95 The elastic material having a hardness deviating from this range generally tends to reduce the pressure applied by the roller due to stress relaxation, thereby making it impossible to form a dielectric layer with a desired thickness, although it depends upon the viscosity of the rib precursor. The tendency is particularly drastic in case where a thin dielectric layer having a thickness ranging from several $\mu$m to several tens $\mu$m.

Since the lamination roller 23 is disposed on the mold 22 so that its rotating shaft is perpendicular to the groove portions 22*g* of the mold 22, the lamination roller is movable along the groove portions of the mold. Accordingly, while the lamination roller 23 is moved, a pressure is applied in order from one end to the other end of the mold 22 due to its own weight G and the groove portions 22*g* are filled in order with the rib precursor 13 as a result of replacement by an air in the groove portions.

When the lamination roller 23 moves along tile groove portions 22*g* of the mold 22, the lamination roller 23 can avoid formation of wrinkles on the mold 22, which is not preferred to the above-described integration molding, by adding(a uniform stress in the width direction of the groove portions of the mold 22. As far as the lamination roller 23 can avoid formation of wrinkles, it can be disposed on the mold 22 so that its rotating shaft is not perpendicular to the groove portions of the mold 22, thereby making it possible to move along the groove portions of the mold 22. Even if the groove portions 22*g* also serve as a channel of an air to entrap the air, the groove portions can efficiently eliminate the air out of the mold 22 when the above pressure is applied. As a result, according to the present invention, it becomes possible to prevent air bubbles from remaining even if filling with the rib precursor 13 is conducted under an atmospheric pressure. In other words, a pressure reducing device is not required upon filling. Of course, air bubbles can be more easily removed in the presence of a pressure reducing device.

At the same time, the lamination roller 23 can form a liquid film, as a template of the dielectric layer, integrally from the rib precursor 13 with a fixed thickness and high accuracy. At this time, the thickness can be adjusted within a range from several $\mu$m to several tens $\mu$m by properly controlling the viscosity of the rib precursor 13 or the diameter, weight or moving rate of the lamination roller 23.

On a stage 21, as shown in FIG. 2, a pair of linear guides 24 may be disposed in parallel substantially to the groove portions 22*g* of the mold 22 between the glass plate 1 and/or mold 22. When these linear guides 24 are provided, the lamination roller 23 can be smoothly moved along the groove portions of the mold 22. As shown in the drawing, the lamination roller 23 may be provided with each bearing support 25 at both ends and attached to the linear guide 24 via the bearing support 25.

Figure 4A:
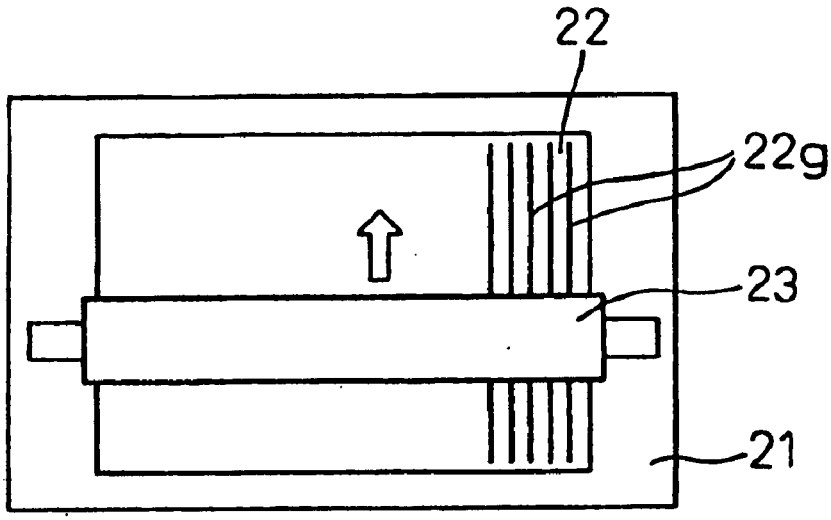
FIGS. 4A–4B are top views for explaining preferred arrangement of a lamination roller in the apparatus for producing the substrate for PDP according to the present invention.
Figure 4B:
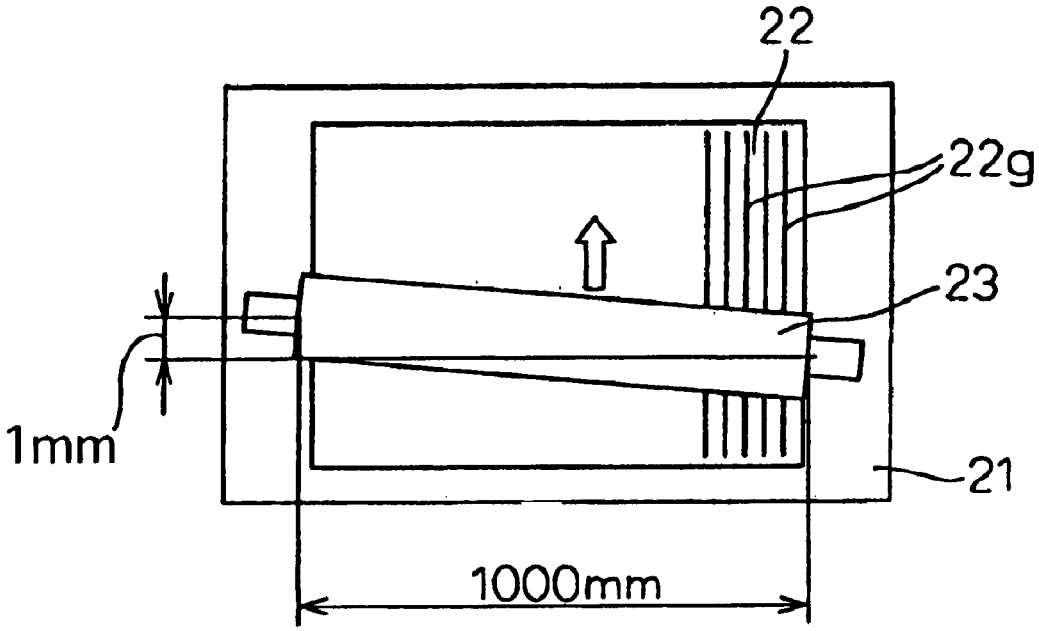

Furthermore, the lamination roller 23 is preferably disposed to the linear guide to the linear guide 24 as shown in FIG. 4(B) so as to avoid formation of wrinkles on the mold 22 when the lamination roller 23 moves on the mold 22. That is, the lamination roller 23 is disposed, as described above and shown in FIG. 4(A), so that its rotating shaft is substantially perpendicular to the groove portions 22*g* (portion of which are shown for simplification of description) of the mold 22. However, as shown in FIG. 4(B), the rotating shaft of the lamination roller is preferably inclined at an angle of about arc tan (1 mm/1000 mm) or less to the direction perpendicular to the linear guide (not shown).

As shown in FIG. 2, at the exterior of a pair of linear guides 24 described above, a second linear guide 26 may be further provided in parallel to them On the linear guide 26, a rotary motor 27 can be provided movably so as to rotate and drive the lamination roller 23. The rotary motor 27 is connected with one end of the lamination roller 23 via a coupling 28, thereby making it possible to move the lamination roller 23 on the linear guide at a predetermined rate while the lamination roller 23 is rotated and driven. In that case, the coupling 28 is preferably a coupling which hardly transmit the weight of the rotary motor 27 to the lamination roller 23 and makes it possible to apply a uniform pressure due to only the lamination roller's own weight A mechanical or electrical position controlling mechanism (not shown)

may be provided so that the rotary motor 27 can move on the linear guide 26 simultaneously with the movement of the lamination roller 23.

The method of producing a substrate for PDP, comprising a glass plate and ribs provided on the glass plate, using the apparatus shown in FIGS. 1 to 3 will now be described with reference to FIG. 5 and FIG. 6 These drawings are sectional views, each showing schematically seven stages in order of the steps of producing the substrate for PDP with reference to FIGS. 5(A) to 5(D) and 6(E) to 6(G).

Figure 5A:
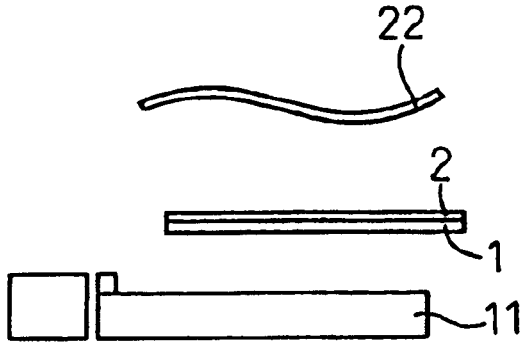
FIGS. 5A–5D are sectional views showing schematically one preferred embodiment (the former half step) of the apparatus for producing the substrate for PDP according to the present invention.

As shown in FIG. 5(A), a glass plate 1 provided with electrodes 2 in parallel with each other in a fixed distance is previously prepared and then disposed on a table 11. If a displaceable stage (not shown) is used as described previously, the table 11, on which the glass plate 11 is placed, is placed on the stage at a predetermined position. Describing in detail, the glass plate 1 is placed so that the electrodes 2 on the glass plate 1 is in parallel with the linear guide (not shown) or perpendicular to the rotating shaft of the lamination roller. Adjustment is also conducted so that the rotating shaft of the lamination roller is preferably inclined at an angle of about arc tan (1 mm/1000 mm) or less to the direction perpendicular to the linear guide.

Next, a pliable mold 22 having groove portions provided in parallel with each other in a fixed distance is prepared and then placed on the glass plate 1 at a predetermined position. At this time, the mold 22 is disposed so that the groove portions are in parallel to the linear guide or perpendicular to the rotating shaft of the lamination roller. In case where a photocurable rib precursor is used in the following step, a transparent mold (which makes it possible to irradiate photocurable rib precursor with light) is used.

Figure 5B:
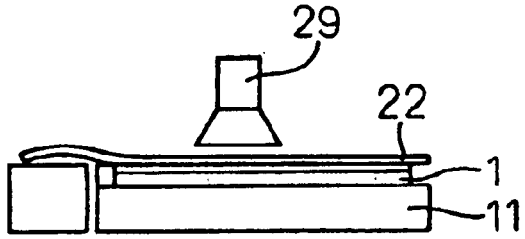
Figure 5C:
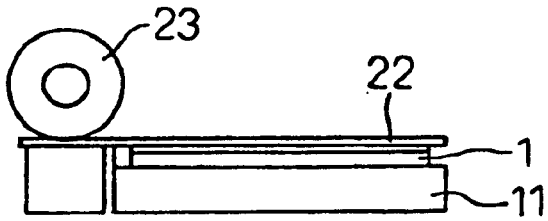

Next, positioning of the glass plate and mold is conducted Describing in detail, this positioning is visually conducted Otherwise, the positioning is conducted by using a sensor 29 such as CCD camera so that the groove portions of the mold 22 are in parallel with the electrodes of the glass plate 22, as shown in FIG. 5(B). At this time, fine adjustment can be conducted by using the above-described displaceable state. If necessary, the distance between the groove portions of the mold 22 and adjacent electrodes on the glass plate may be reconciled by adjusting the temperature and humidity. Usually, the mold 22 and glass plate 1 expand and contract according to a change in temperature and humidity and the degree of expansion and contraction varies each other. Accordingly, after the completion of the positioning of the glass plate and mold, the temperature and humidity are controlled to maintain within a fixed range. Such a control method is particularly effective in the production of a substrate for PDP having a large area Subsequently, as shown in FIG. 5(C), the lamination roller 23 is placed oil one end of the mold 22. At this time, one end of the mold 22 is preferably fixed on the glass plate 1. Because it is possible to prevent deviation of the positioning of the glass plate and mold after the completion of the positioning.

Figure 5D:
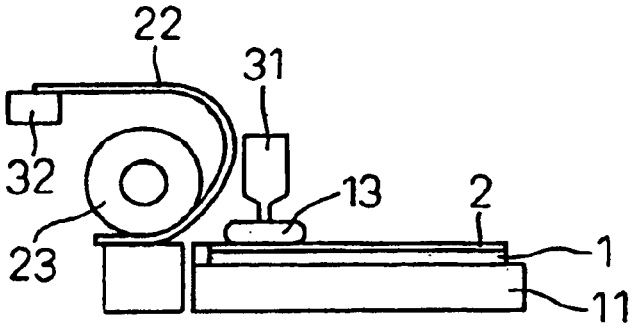

Then, as shown in FIG. 5(D), the mold 22 is moved upward over the lamination roller 23 by lifting the other free end of the mold 22, thereby exposing the glass plate 1. At this time, a tension is not applied to the mold 22 so as to prevent formation of wrinkles on the mold 22 or to maintain the positioning of the mold 22 and glass plate 1. Note that any other means may be used insofar as positioning of the mold 22 and glass plate 1 can be maintained. Then, the rib precursor 13 in fixed amount enough to form ribs is supplied on the glass plate 1. In the embodiment of the drawing, a hopper 31 for paste with a nozzle is used as the above-described rib precursor supplying, device.

In the practice of the present invention, it is not necessary to uniformly supply the rib precursor 13 on the whole glass plate 1. As shown in FIG. 5(D), the rib precursor 13 may be supplied only on the glass plate 1 in the vicinity of the lamination roller 23. As described hereinafter, when the lamination roller 23 moves on the mold 22, the rib precursor 13 can be uniformly spread on the glass plate 1. In such case, the rib precursor 13 generally has a viscosity of about 100,000 cps or less, preferably, a viscosity of about 20,000 cps or less. When the viscosity of the rib precursor is higher than about 100,000 cps, it becomes difficult to spread the rib precursor by the lamination roller 23 and, as a result, an air is likely to be entrapped in the groove portions of the mold 22, thereby causing defects of ribs.

Figure 6E:
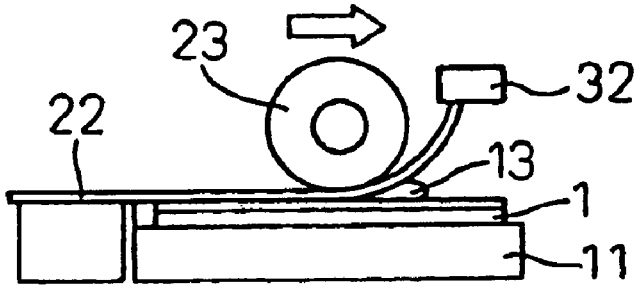
FIGS. 6E–6G are sectional views showing schematically one preferred embodiment (the latter half step) of the apparatus for producing the substrate for PDP according to the present invention.
Figure 6F:
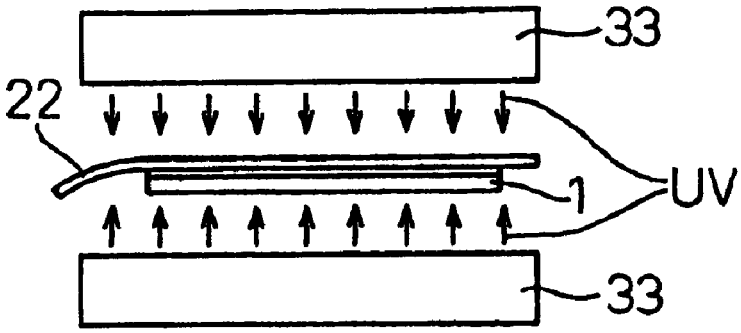

Next, a rotary motor (not shown) is driven, thereby to move the lamination roller 23 along the groove portions on the mold 22 at a predetermined rate, as shown by the arrow in FIG. 6(E). While the lamination roller 23 moves on the mold 22 in such way, a pressure is applied to the mold 22 from one end to the other end in order by the lamination roller's own weight, and the groove portions 22*g* are filled in order with the rib precursor 13 as a result of replacement by an air in the groove portions. At the same time, a liquid film as a template of the dielectric layer can be molded integrally from the rib precursor with a fixed thickness and high accuracy. At this time, the thickness of the rib precursor can be adjusted within a range from several $\mu$m to several tens $\mu$m by properly controlling the viscosity of the rib precursor or the diameter, weight or moving rate of the lamination roller.

According to the present invention, even if the groove portions also serve as a channel of an air to entrap the air, the groove portions can efficiently eliminate the air out of the mold when the above pressure is applied. As a result, according to the present invention, it becomes possible to prevent air bubbles from remaining even if filling with the rib precursor is conducted under an atmospheric pressure In other words, it becomes unnecessary to reduce the pressure upon filling of the rib precursor. Of course, the reduced pressure may be applied to attain easy removal of air bubbles.

Next, the rib precursor is cured. In case where the rib precursor spread on the glass plate 1 is photocurable, as shown in FIG. 6(F), the rib precursor (not shown) is put in a light irradiating device 33, together with the glass plate 1 and mold 22, and the rib precursor is irradiated with light such as ultraviolet light (UV) via the glass plate 1 and/or mold 22, thereby to cure the rib precursor. In such way, a molded article of the rib precursor is obtained.

Figure 6G:
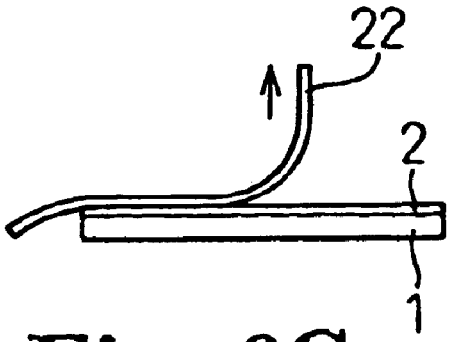

After the resulting molded article is removed from the light irradiating device, together with the glass plate 1 and mold 22, the mold 22 is released as shown in FIG. 6(G). Such release is conducted along the groove portions of the mold 22 from one end to the other end as shown by the arrow in FIG. 6(G). When the mold 22 is released in the state of being departed from the direction of the groove portions, breakage of the molded article occurs.

Furthermore, in case where the curing agent or polymerization initiator contained in the rib precursor has an absorption end at a wavelength longer than that of the photocuring initiator of the molding portion, as described above, adhesion between the mold and molded article is avoided, thereby making, it possible to further prevent breakage of the molded article. In case where the mold is subjected to antistatic finish, charging on release is avoided and its handling becomes easy.

Figure 7:
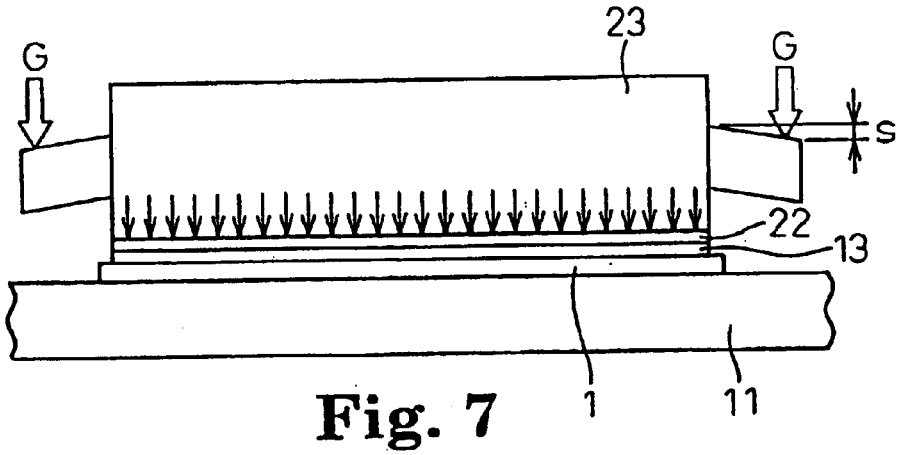
FIG. 7 is a sectional view showing schematically one preferred step of the method of producing the substrate for PDP according to the present invention.

While the present invention has been described in detail with respect to preferred embodiments thereof, the present invention is not limited by these embodiments For example, two bearing supports 25 may be coupled with a beam (not shown) to move them In the embodiment described above, the mold was tilled with the precursor by applying a pressure to the mold utilizing the lamination roller's own weight, however, the present invention is not limited to only such a filling procedure For example, as shown in FIG. 7, when the lamination roller 23 moves along the groove portions (not shown) of the mold 22, a load G may be applied to both ends of the rotating shaft. Describing in detail, when the load G is applied to both ends of the rotating shaft of the lamination roller 23 via the mold pressing, portion (as pressure applying means, not shown), minus displacement s takes place, resulting in deflection of the rotating shaft In the interior of the lamination roller 23, a reaction force is produced due to the minus displacement s, which is applied to the mold 22.

In the embodiment shown in FIG. 7, the lamination roller 23 preferably has comparatively high rigidity and mechanical accuracy so that deflection of the lamination roller is prevented, thereby making it possible to apply a uniform reaction force to the mold in the longitudinal direction. Also the mold pressing portion preferably has rigidity and mechanical accuracy so that a uniform and fixed reaction force is applied to the mold 22 in the longitudinal direction of the lamination roller 23. Typical examples of such mold pressing portion include those using force screw, air cylinder, sinker, etc., but are not limited thereto.

Without providing the second linear guide recognized in the apparatus for producing the substrate for PDP described previously with reference to FIG. 2, a rotary motor may be disposed on one linear guide out of a pair of linear guides, together with a bearing support of the lamination roller, via a coupling. In this case, the rotary motor moves on the linear guide, together with the lamination roller and its bearing portion, by driving thereof. Usually, the other linear guide out of a pair of linear guides is provided with a sinker having almost the same weight as that of the rotary motor. At this time, running resistance becomes identical at both ends of the lamination roller.

In the above embodiment, the driving, portion such as rotary motor applies a rotary motion to the lamination roller, thereby to move the lamination roller forward along the groove portions of the mold, however, the present invention is not limited to such a driving system. Without using the above-described rotary motor and second linear guide, the rotary motor acts directly on the bearing portion of the lamination roller, thereby to move the lamination roller on the linear guide. In such case, the lamination roller is not rotated by the rotary motor. However, while the lamination roller moves, contact resistance produces between the lamination roller and mold, thereby making it possible to rotate the lamination roller. At this time, there is a fear that rolling resistance produces on the lamination roller, thereby deforming the mold. Particularly, in case where the mold is cumulatively stretched by deformation, lowering of the transfer position accuracy of ribs and generation of wrinkles are likely to occur. Accordingly, in this case, the lamination roller preferably has low rolling resistance as possible.

Figure 8:
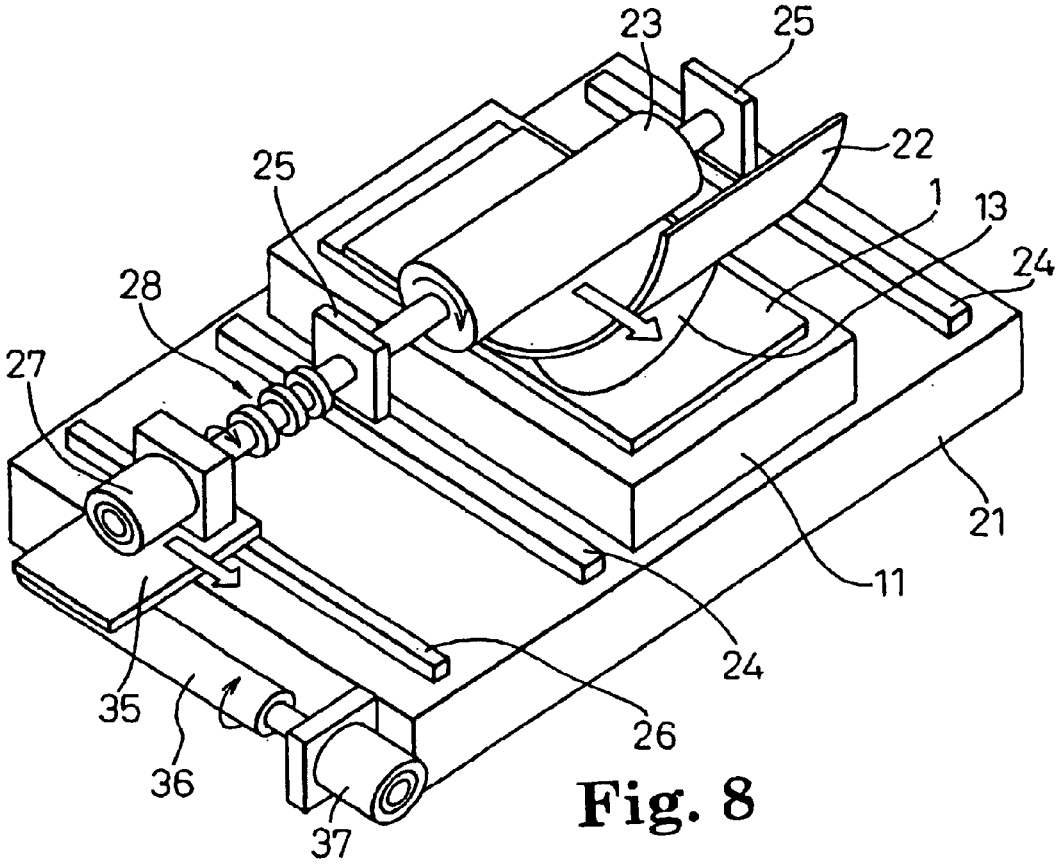
FIG. 8 is a perspective view showing another preferred embodiment of the apparatus for producing the substrate for PDP according to the present invention
Figure 9:
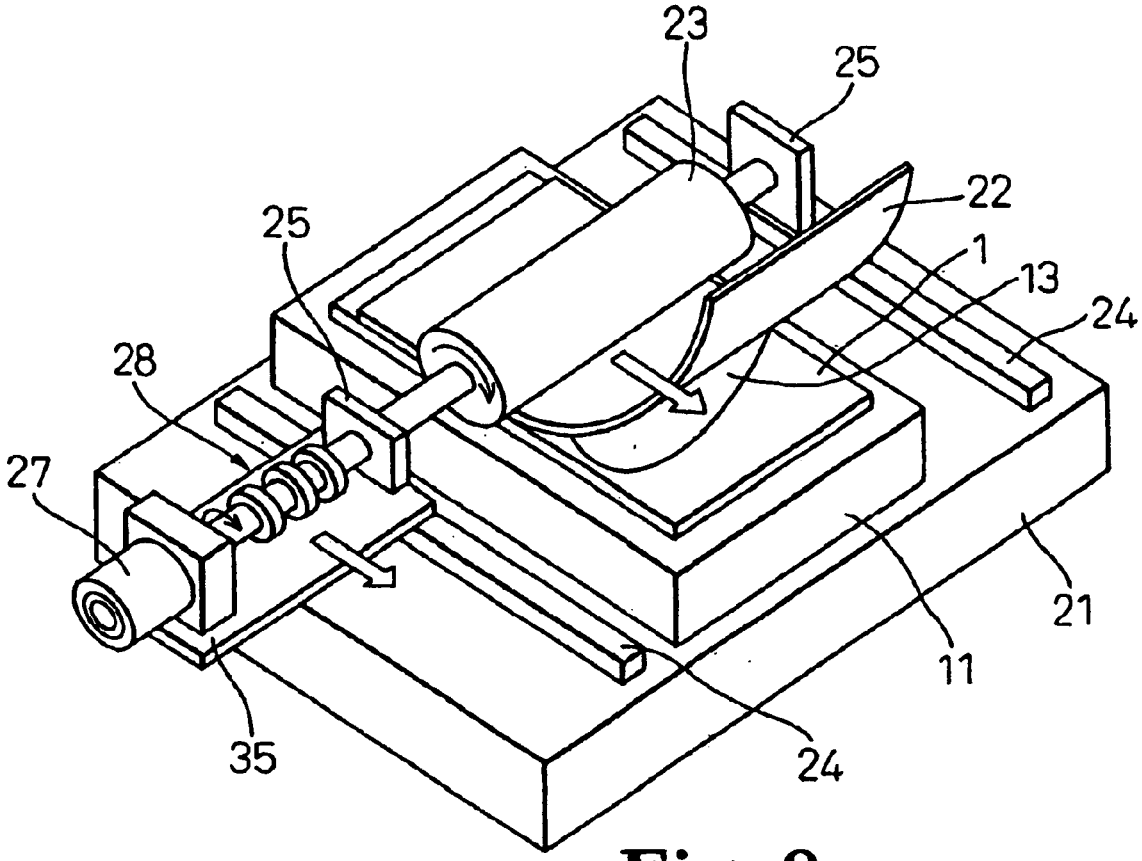
FIG. 9 is a perspective view showing still another preferred embodiment of the apparatus for producing the substrate for PDP according to the present invention.
Figure 10:
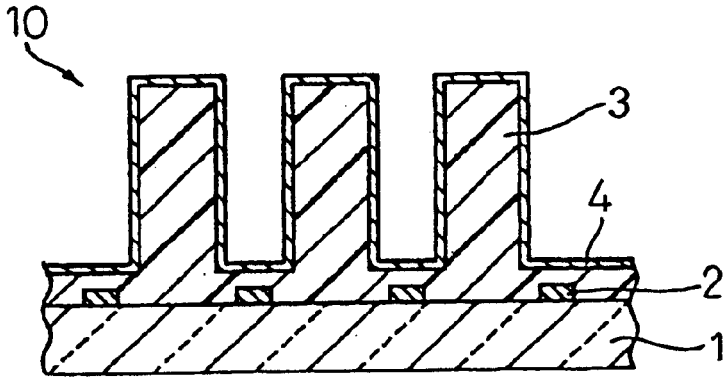
FIG. 10 is a sectional view showing a typical constitution of a conventional substrate for PDP.

FIGS. 8 and 9 are perspective views, each showing schematically a typical example of the apparatus for producing the substrate for PDP in accordance with the above-described embodiment. Since a principal constitution of these apparatuses is the same as that of the apparatus for producing the substrate for PDP described previously with reference to FIGS. 1 to 3, it is appreciated to make reference to the previous detailed description.

In the apparatus for producing the substrate for PDP shown in FIG. 8, a second linear guide 26 serves as a linear guide for moving a common basement 35 to which a rotary motor 27 is attached. This apparatus is provided with a synchronous moving mechanism 36 for synchronous moving of the rotary motor 27, and the synchronous moving mechanism 36 can be driven by a rotary motor 37.

The apparatus for producing the substrate for PDP shown in FIG. 9 is not provided with the second linear guide. In this apparatus, a common basement 35, on which a bearing support 25, a coupling 28 and a rotary motor 27 are attached, can be moved on the linear guide 24.

In the above-described substrate for PDP, ribs are arranged in one direction on a glass plate using a mold with groove portions provided in parallel with each other at a fixed distance, but the present invention is not limited thereto. Using, a mold with groove portions intersecting each other, ribs may be arranged on the glass plate to form a parallel cross pattern. Usually, groove portions of the mold intersect each other, whereby ribs intersecting corresponding intersection of the groove portions are arranged on the glass plate. Such intersecting rib patterns can be made in substantially the same manner as in the method described with reference to FIG. 5 and FIG. 6, except for filling the groove portions with the rib precursor and removal of the mold.

For example, filling of the groove portions of the mold with the rib precursor can be conducted by moving lamination rollers in two different directions along the groove portions. Describing in more detail, as shown in FIGS. 5(A) to 6(E), lamination rollers are moved on the mold along the groove portions arranged in one direction and the groove portions are filled with the rib precursor. After the lamination rollers or mold are relatively rotated by 90°, as shown in FIGS. 5(A) to 6(E), additional groove portions arranged in the direction perpendicular to the direction of the above groove portions arranged are subsequently filled with the rib precursor Thus, in case where ribs with a complicated pattern are provided on the glass plate using the mold provided with the groove portions in plural directions, all groove portions can be filled with the rib precursor by applying a pressure along the groove portions plural times as described above Alternatively, as far as filling with the rib precursor can be conducted, groove portions of the mold may be inclined at about 45° or less to the forward direction of lamination rollers.

In case of a non-linear rib pattern such as parallel cross pattern, it is usually design the height and shape so that ribs do not put obstacles to the mold on release. At this time, removal of the mold is conducted in the direction wherein the mold does not put obstacles to ribs, thereby releasing stably.

EXAMPLES

The present invention will be described by the following examples. It is appreciated that such examples, however, are not construed as limiting in any way the present invention.

Example 1

First, the following components were mixed in the weight ratio described below to prepare a mixed solution.

Aliphatic urethane acrylate oligomer (manufactured by Henkel Co. under the trade name of "Photomer 6010"):

90 Parts by weight

Photocuring initiator (2-hydroxy-2-ethyl-1-phenyl-propan-1-one, manufactured by Clariant Co. under the trade name of "Darocure 1173"):

1 Part by weight

High dielectric medium (propylene carbonate, manufactured by Wako Pure Chemical Industries Co., Ltd.):

8.1 Parts by weight

Ionic conductive substance (lithium perchlorate, manufactured by Wako Pure Chemical Industries Co., Ltd.):

0.9 Parts by weight

A polyethylene terephthalate (PET) film having a thickness of 50 $\mu$m was finely cut to make two film pieces (30 cm in width and 20 cm in length).

Next, 5 $cm^3$ of the above mixed solution was dropped on one of two film pieces thus obtained. Then, one film piece was laid via the mixed solution on the film piece, thereby to spread the mixed solution in the form of a thin film. In that case, the thickness of the thin film of the mixed solution was adjusted to 500 $\mu$m by a knife coater. Using a UV light source, the thin film of the mixed solution was irradiated with light having a wavelength ranging from 200 to 450 nm via the above film piece for 30 seconds, thereby to cure the thin film.

The surface resistance of the resulting was measured by the procedure defined in EOS/ESD (Electric Overstress/Electrostatic Discharge) association standard S11.11. The electrostatic voltage of the same sheet was measured by the following procedure. A PET film having a thickness of 50 $\mu$m was applied on a test sheet and, immediately after peeling the test sheet quickly, the electrostatic voltage of the sheet was measured by using a portable static meter (manufactured by 3M Co.). As a result, the following measurement results were obtained.

Surface resistance of sheet: $2.0\times10^9$ Ω/□

Electrostatic voltage of sheet: nearly 0 V (voltage)

As is apparent from the above measurement results, the sheet made in this example is hardly charged actually. Accordingly, it is found that the surface resistance of this example is a low value enough to prevent the sheet from charging.

Subsequently, as described below, a mold was actually made from the above mixed solution and a substrate for PDP was produced by using the mold First, there was previously prepared a metal mold having a surface provided with protrusion portions corresponding to the shape of ribs in one direction at a distance, in order to use for forming ribs from the mixed solution. After the surface portion of the metal mold was filled with the mixed solution, a PET film was adhered to the metal mold via the mixed solution. In the same manner as in case of the above-described production of the sheet, the mixed solution was irradiated with light of 200 to 450 nm from a UV light source for 30 seconds, thereby to conduct photocuring of the mixed solution. Then, the metal mold was removed and a mold having groove portions corresponding to the shape of ribs was removed. At this time, it was visually confirmed that this mold is transparent and has pliability.

Then, the removed mold was applied to the above-described apparatus for producing a substrate and the groove portions were filled with a photocurable rib precursor. The formulation of the photocurable rib precursor is as follows Bisphenol A diglycidyl ether methacrylic acid adduct (manufactured by Kyoeisha Chemical Co., Ltd.):

5 Parts by weight

Triethylene glycol dimethacrylate (manufactured by Pure Chemical Industries Co., Ltd.):

5 Parts by weight 1,3-butanediol (manufactured by Pure Chemical Industries Co., Ltd.).

10 Parts by weight

Photocuring initiator (bis(2,4,6-trimethylbenzoyl)-phenylphosphineoxide, manufactured by Ciba-Greigy Co. under the trade name of "Irgacure 819"):

0.1 Parts by weight

POCA (phosphate propoxyalkyl polyol):

0.5 Parts by weight

Mixed powder of lead glass and ceramic (manufactured by Asahi Glass Co., Ltd. under the trade name of "RFW-030"):

79.4 Parts by weight

Using a fluorescent lamp, the rib precursor was irradiated with light having a wavelength ranging from 400 to 500 nm via both of the mold and the glass plate for 30 seconds to obtain a cured article. Then, the mold was removed and the cured article was transferred to the glass plate At this time, it was observed that any cured article is remained in the mold and surroundings charged dusts are hardly adhered thereto. On the other hand, it has been found that the cured article transferred to the glass plate has a uniform shape on the glass plate and an air is hardly entrapped.

Example 2

The same procedure as in Example 1 was repeated, except that the following components (which are the same as those used in Example 1) were mixed in the weight ratio described below to prepare a mixed solution in this example, and a sheet was made Aliphatic urethane acrylate oligomer 96 Parts by weight.

Photocuring initiator:

1 Part by weight

High dielectric medium:

3.6 Parts by weight

Ionic conductive substance:

0.4 Parts by weight

In the same manner as in Example 1, the surface resistance and electrostatic voltage of the resulting sheet were measured. As a result, the following measurement results were obtained.

Surface resistance of sheet: $3.3\times10^{10}$ Ω/□

Electrostatic voltage of sheet: nearly 0 V

The surface resistance of the sheet of this example is higher that that of Example 1. However, the electrostatic voltage is nearly 0 V and the sheet is hardly charged actually. Accordingly, it is found that the surface resistance of this example is a low value enough to prevent the sheet from charging.

Subsequently, a mold was actually made from the above mixed solution in the same manner as in Example 1. As a result, the cured article could be transferred onto the glass plate by using the mold. It was observed that any cured article is remained in the mold and surrounding charged dusts are hardly adhered thereto after transferring the cured article to the glass plate. On the other hand, it has been found that the cured article transferred to the glass plate has a uniform shape on the glass plate and an air is hardly entrapped.

Example 3

The same procedure as in Example 1 was repeated, except that the following components (which are the same as those used in Example 1) were mixed in the weight ratio described below to prepare a mixed solution in this example, and a sheet was made Aliphatic urethane acrylate oligomer.

99 Parts by weight

Photocuring initiator:

1 Part by weight

In the same manner as in Example 1, the surface resistance and electrostatic voltage of the resulting sheet were measured. As a result, the following, measurement results were obtained.

Surface resistance of sheet: $2.0\times10^{14}$ Ω/□ or more

Electrostatic voltage of sheet: 2000 V or higher

The surface resistance of the sheet of this example is higher that that of Example 1. Furthermore, the electrostatic voltage is 2000 V or higher and the sheet is actually charged. Accordingly, it is found that the surface resistance of this example is not a low value enough to prevent the sheet from charging.

Subsequently, a mold was actually made from the above mixed solution in the same manner as in Example 1, and then the cured article was transferred onto the glass plate by using the mold. In this example, however, the surface resistance of the sheet is not a low value enough to prevent the sheet from charging. Therefore, any cured article is remained in the mold and surrounding charged dusts are hardly adhered thereto after transferring the cured article to the glass plate. Furthermore, although the cured article has a uniform shape on the glass plate and an air is hardly entrapped, defects are observed because surrounding charged dusts are adhered to the mold.

As described above, according to the present invention, (1) it is not necessary to previously coat a photosensitive ceramic paste (photocurable ceramic) containing a photocurable resin on the whole surface of a mold or a substrate glass;

(2) a photocurable ceramic paste supplied to a lamination starting point between a mold having pliability and a glass plate is laminated in the same direction as that of ribs on the mold using a roller, thereby making it possible to uniformly spread the photocurable ceramic paste between the mold and glass plate without requiring an operation in an atmosphere under reduced pressure while preventing entrapment of air bubbles very effectively;

(3) ribs and a dielectric layer, each having a uniform thickness, can be molded simultaneously and the dielectric layer and ribs, each having a uniform thickness, can be molded simultaneously on a glass plate by curing, a photocurable ceramic paste in the state of being laminated and removing the mold;

(4) high quality ribs can be produced at high position accuracy and, at the same time, a dielectric layer having a uniform thickness can be produced simultaneously, thereby making it possible to produce the dielectric layer and ribs at extremely low cost, (5) when using a lamination roller having high cylindricity, with which a plastic material is surrounded, lamination can be conducted by applying a load utilizing only its own weight and a slight error in thickness of a glass plate and a mold as well as deflection of a roller and an error in flatness of the work face of machines can be easily permitted, thereby making it possible obtain a dielectric layer having, any uniform thickness ranging from several μm to several tens μm on a glass plate having a wide area having a width of not less than 1 m and a length of not less than 0.6 m and a uniform rib shape in a wide area;

(6) lamination is conducted in an environment at a predetermined temperature utilizing a difference in thermal expansion coefficient between a mold and a glass plate, thereby making it possible to control a pitch between ribs on the mold correspondingly to that of electrodes on the glass plate, and (7) regarding formation of a complicated rib pattern such as lattice pattern, filling of rib grooves on a mold with a paste can be sufficiently conducted by repeating a lamination step in transverse and longitudinal directions, thereby making it possible to produce a complicated pattern having high quality in the same manner.

What is claimed:

1. An apparatus for producing a substrate for plasma display panel comprising a plate and ribs provided on the plate, which comprises:

a table for the plate, a rib precursor supplying portion for providing a precursor of the ribs on the plate, a pliable mold having at least groove portions provided in parallel with each other at a fixed distance, which is disposed on the precursor of the ribs provided on the plate, a mold pressing portion for applying a pressure to the mold, thereby to contact the mold closely with the plate via the precursor of the ribs, and a driving portion for moving the mold pressing portion along the groove portions of the mold; wherein the driving portion comprises a pair of linear guides provided in parallel with the groove portions of the mold, which is interposed between the linear guides, and the mold pressing portion is movable along the linear guide.

2. The apparatus according to claim 1, wherein the mold pressing portion is a lamination roller and the driving portion further comprises:

at least one second linear guide disposed in parallel with a pair of linear guides at the exterior of the linear guides, a rotary motor provided movably on the second linear guide, and a coupling for connecting a rotating shaft of the rotary motor with that of the lamination roller.

* * * * *

UNITED STATES PATENT AND TRADEMARK OFFICE

CERTIFICATE OF CORRECTION

PATENT NO. : 6,761,607 B2
DATED : July 13, 2004
INVENTOR(S) : Kikuchi, Hiroshi

It is certified that error appears in the above-identified patent and that said Letters Patent is hereby corrected as shown below:

Title page,
Item [56], References Cited, FOREIGN PATENT DOCUMENTS, delete "A2 A3" and insert -- A2/A3 --, therefor and after "WO 01/95361" insert -- A2/A3 --.
Item [57], ABSTRACT,
Line 5, delete "precusor" and insert -- precursor --, therefor.

Column 1,
Line 41, delete "9-122336" and insert -- 9-12336 --, therefore.

Column 2,
Line 2, after "reduction" insert -- . --.
Line 8, after "pliability" insert -- . --.

Column 3,
Line 17, after "showing" delete ",".
Line 40, after "invention" insert -- . --.

Column 4,
Line 49, after "advantageous" insert -- . --.

Column 5,
Line 26, delete "ie." and insert -- i.e. --, therefor.
Line 55, after "95" insert -- . --.

Column 6,
Line 2, after "G" insert -- , --.
Line 5, delete "tile" and insert -- the --, therefor.
Line 9, after "adding" delete "(".
Line 56, after "them" insert -- . --.
Line 66, after "weight" insert -- . --.

Column 7,
Line 7, after "FIG. 6" insert -- . --.
Lines 34 and 35, after "conducted" insert -- . --.
Line 50, after "area" insert -- . --.
Line 53, delete "oil" and insert -- on --, therefor.

UNITED STATES PATENT AND TRADEMARK OFFICE

CERTIFICATE OF CORRECTION

PATENT NO. : 6,761,607 B2
DATED : July 13, 2004
INVENTOR(S) : Kikuchi, Hiroshi

It is certified that error appears in the above-identified patent and that said Letters Patent is hereby corrected as shown below:

Column 8,
Line 2, after “supplying” delete “,”.
Line 39, after “pressure” insert -- . --.
Line 66, after “making” delete “,”.

Column 9,
Line 5, after “embodiments” insert -- . --.
Line 7, after “them” insert -- . --.
Line 8, delete “tilled” and insert -- filled --, therefor.
Line 12, after “procedure” insert -- . --
Line 17, after “pressing” delete “,”.
Line 19, after “shaft” insert -- . --.
Line 46, after “driving” delete “,”.

Column 10,
Line 24, after “using” delete “,”.
Line 46, after “precursor” insert -- . --.
Line 51, after “above” insert -- . --.

Column 11,
Line 49, after “mold” insert -- . --.
Line 67, after “follows” insert -- . --.

Column 12,
Line 8, delete “Ltd.).” and insert -- Ltd.): --, therefor.
Line 25, after “plate” insert -- . --.
Line 27, delete “surroundings” and insert -- surrounding --, therefor.
Line 38, after “made” insert -- . --.
Line 38, after “oligomer” insert -- : --.

Column 13,
Line 7, after “made” insert -- . --.
Line 8, after “oligomer” delete “.” and insert -- : --, therefor.
Line 60, delete “,” and insert -- ; -- therefor.

UNITED STATES PATENT AND TRADEMARK OFFICE

CERTIFICATE OF CORRECTION

PATENT NO. : 6,761,607 B2
DATED : July 13, 2004
INVENTOR(S) : Kikuchi, Hiroshi

It is certified that error appears in the above-identified patent and that said Letters Patent is hereby corrected as shown below:

Column 14,
Line 19, delete "," and insert -- ; --, therefor.

Signed and Sealed this

Sixteenth Day of November, 2004

JON W. DUDAS
*Director of the United States Patent and Trademark Office*